United States Patent [19]

Gawler et al.

[11] Patent Number: 5,020,428

[45] Date of Patent: Jun. 4, 1991

[54] PRINTED STAMP MACHINE

[75] Inventors: David A. Gawler; Dennis T. Gilham, both of Brentwood; Thomas D. Williams, Billericay, all of United Kingdom

[73] Assignee: Alcatel Business Systems Limited, Essex, United Kingdom

[21] Appl. No.: 457,493

[22] Filed: Dec. 27, 1989

[30] Foreign Application Priority Data

Dec. 30, 1988 [GB] United Kingdom ..... 8830419

[51] Int. Cl.[5] ..... B41L 47/46

[52] U.S. Cl. ..... 101/91; 101/87

[58] Field of Search ..... 101/91, 92, 77, 86, 101/87

[56] References Cited

U.S. PATENT DOCUMENTS 2,179,232 7/1936 Ogden ..... 101/91

4,246,643 1/1981 Hubbard ..... 101/91

4,724,759 2/1988 Gilham et al. ..... 101/91

*Primary Examiner*—Edgar S. Burr

*Assistant Examiner*—C. A. Bennett

*Attorney, Agent, or Firm*—Shoemaker and Mattare, Ltd.

[57] ABSTRACT

A stamp printing machine has print drum carrying print wheels which are settable by push buttons to print a selected value of postage charge. The drum is driven by a mechanical device such as tensator spring motor. The motor is manually primed and a trip lever operated by insertion of mail item releases the print drum to rotate through one revolution to print the stamp on the mail item. The stamp machine may include a calculator on which the postage value may be manually entered. Electrical contacts operated by the rotation of the drum are connected across the M+ button of the calculator to add the postage amount to its memory.

13 Claims, 4 Drawing Sheets

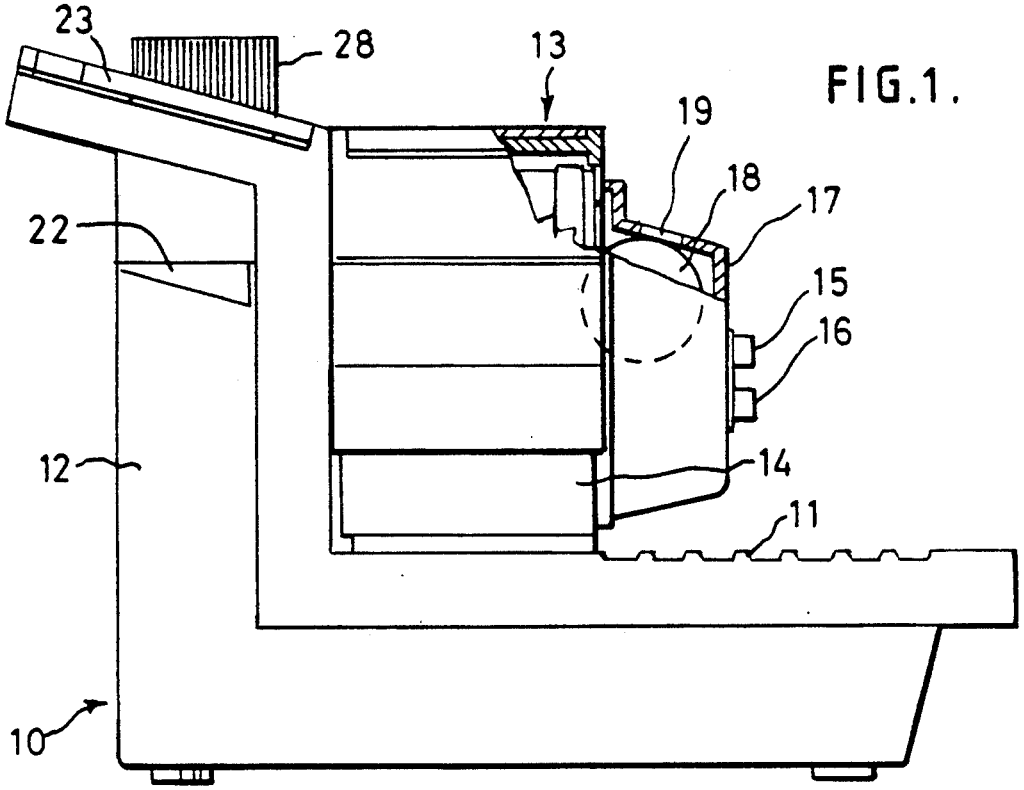
FIG.1.
FIG.2.
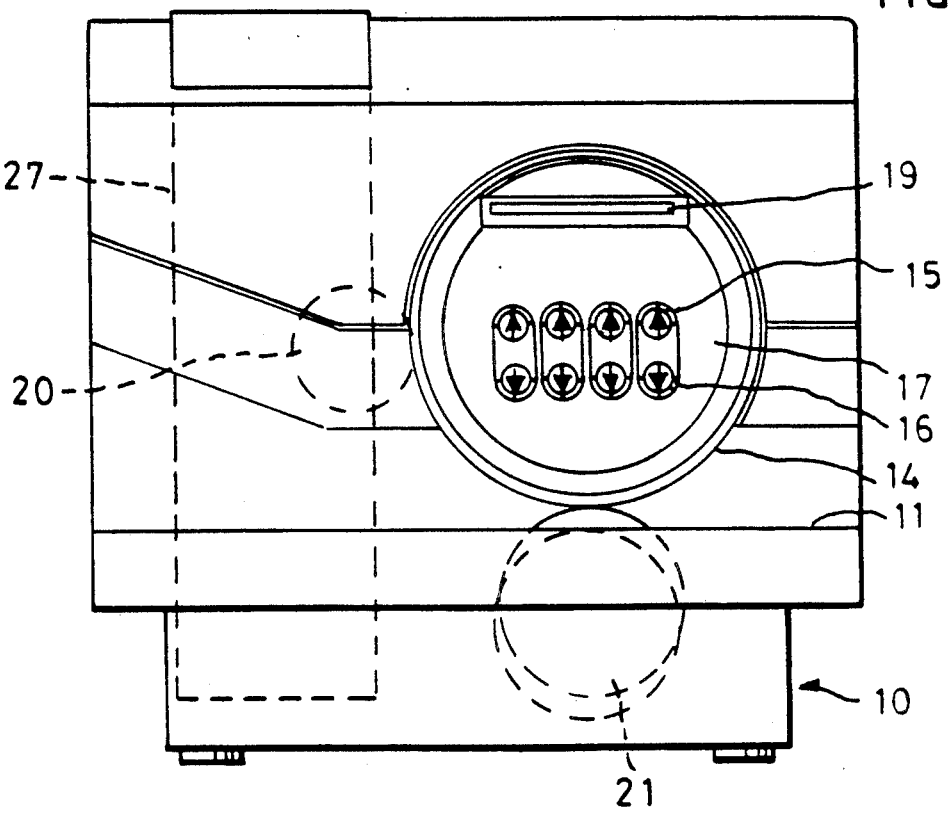

PRINTED STAMP MACHINE

BACKGROUND OF THE INVENTION

This invention relates to machines for applying a printed stamp to postal items.

When items are to be carried by a postal authority for delivery to a destination address, payment for carriage of the item is made to the postal authority by purchase of one or more postage stamps which are then affixed to the postal item. The stamps affixed to the postal item provide an indication during subsequent handling of the postal item by the postal authority that a postage charge has been paid and the amount or value of the postage charge paid.

The purchase and affixing of postage stamps is inconvenient particularly for regular senders of postal items requiring different values of postage such as small commercial users of the postal service. In order to overcome the need for purchase of postage stamps prior to despatch of postal items, franking machines were introduced. Franking machines are operated by persons or companies desiring to despatch postal items and are operated under licence from the postal authority. The franking machine is caused to print on the postal item a frank impression of a form prescribed by the postal authority which includes an impression of the value of postage franked on the item. In order for the user of the franking machine to be able to account to the postal authority for the value of postage used to the satisfaction of the postal authority, it has been necessary to provide the franking machine with accounting means to maintain an accurate record of the usage of the machine and the accumulated value of franking applied by the machine. Commonly, the postal authority requires prepayment for usage of the machine. Accordingly the machine includes a register to record the value of credit, purchased by the user from the postal authority, which remains available for usage in franking. The machine is constructed such that, when the registered value of credit decreases to a predetermined low limit, the machine locks and prevents further usage of the machine until additional credit has been entered in the register of the machine by the postal authority in response to payment by the user.

Modern franking machines utilise electronic circuits for carrying out accounting and control functions within the machine. These circuits include a microprocessor and memory devices providing registers for registering accounting values. The registers usually include a descending register into which the value of purchased credit is entered and which is decremented during usage of the machine by the value of franking used in each franking transaction. The registers also include an ascending register to register the accumulated value of franking used and an items register for registering the number of mail items franked by the machine. In order to maintain integrity of the values registered in the various registers, each of the registers is replicated, each replication storing corresponding values. Thus if due to a fault in the operation of the electronic circuits the value registered in one of the replications of a register differs from the value registered in the other replications of that register an indication is provided that a fault has occurred and the true accounting value can be retrieved from the other replications of that register.

If the electronic accounting circuits and the value setting mechanisms by which print elements for printing the value of franking are unprotected, the values registered in the registers and/or the values of postage printed in the franking could be changed by anyone with fraudulent intent. Accordingly it has been necessary to house the circuitry and printing mechanism in a secure manner such as to prevent unauthorised access to these parts of the machine.

The provision of replicated registers and particularly the provision of a secure housing for the circuits and print setting mechanism adds greatly to the cost of manufacturing franking machines. As a result franking machines are too expensive for purchase by users who despatch relatively small quantities of postal items and therefore users who despatch relatively small quantities of postal items are compelled to use postage stamps which may be inconvenient, time consuming and in addition are somewhat un-hygienic to use.

SUMMARY OF THE INVENTION

According to a broad aspect of the present invention a postage stamping machine includes means to set a selected postage value for printing; printing means operable in a print cycle to print a postage impression comprising the selected postage value and an identification on a mail item; input power means operable to power the print means to effect printing of the postage impression; means responsive to receipt of a mail item to initiate operation of the input power means to power and operate the print means.

According to another aspect of the present invention a postage stamping machine comprises a base unit; a print drum rotatable relative to the base unit and carrying settable print elements for printing a postal impression and value on a postal item; manually operable means on the drum to set the print elements to print a desired value of postage; and a mechanical spring powered motor operable to rotate said print drum to effect printing of a postal item with the desired value of postage.

The spring powered motor may comprise a tensator spring motor with means to manually prime the motor.

Preferably the manually operable means for setting the print elements includes manually operable buttons connected to said print elements by ratchet means, each operation of a button being effective to move the print element by one increment. A first manually operable button may be connected to the print element by the ratchet means in such manner that operation of the first button is effective to move the print element by one increment in an increasing value direction and a second manually operable button may be connected to the print element by the ratchet means in such manner that operation of the button is effective to move the print element by one increment in a decreasing value direction.

A calculator having digital input buttons for the manual input of values corresponding to postal values to which the print elements are manually set and having a memory may be provided on the stamping machine. Memory input means on the calculator would be operable to enter a value, manually input by means of said digital input buttons, into said memory; and means operated in response to rotation of the print drum through a printing cycle would be provided to operate said memory input means.

BRIEF DESCRIPTION OF THE DRAWINGS

An embodiment of the invention will now be described by way of example with reference to the drawings in which:

FIG. 1 is a side elevation of a post stamping machine,

FIG. 2 is a front elevation of the post stamping machine,

DESCRIPTION OF THE PREFERRED EMBODIMENT

Figure 6:
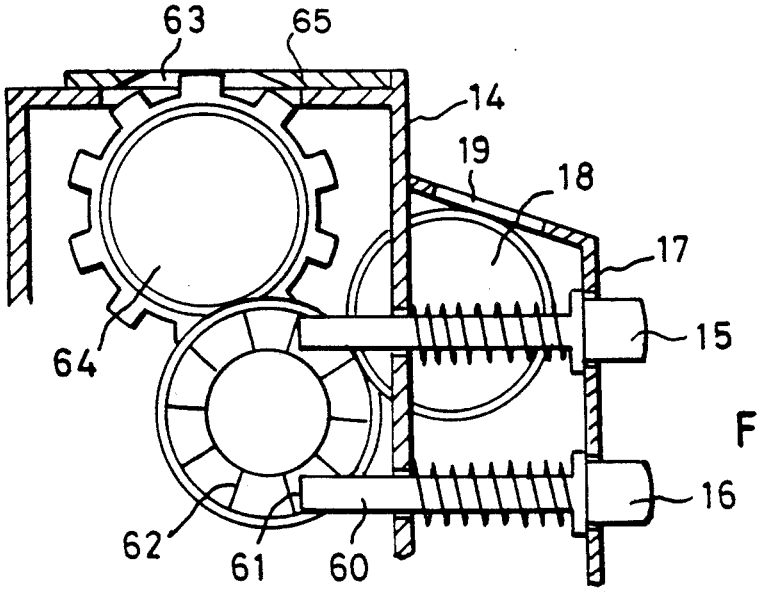
FIG. 6 illustrates the print wheel setting mechanism.

Referring to FIG. 1 initially, the stamping machine comprises a base 10 formed to provide a horizontal feed bed 11 for postal items and a rear housing 12 for carrying the components of a printing mechanism 13 for printing a stamping on postal items. The printing mechanism 13 comprises a drum 14 mounted on a shaft extending forwardly from the rear housing 12 and rotatable about a horizontal axis. The periphery of the drum carries a printing plate 65 (FIG. 6) formed to print the fixed pattern of the impression as required by the postal authority. The printing plate is apertured 63 to permit settable print elements, 64 for printing variable data comprising the value of the postage and the date, to project from the interior of the print drum 14 into alignment with a printing surface of the printing plate. The settable printing elements comprise two groups of print wheels having type faces on their peripheries and are rotatable about axes to bring a required type face into printing position in the aperture of the printing plate. A group of print elements 64 comprising four print wheels is utilised for printing the value of postage on the postal item. The four print wheels are set individually so as to print in combination a desired postage value. The print wheels of the group are set to the required settings by means of pairs of manually operable push buttons 15, 16 located at the front of the print drum. The push buttons 15, 16 are mounted on the ends of members 60 (FIG. 6) which are movable longitudinally relative to the print drum 14. Each member carries a ratchet tooth 61 to engage with the teeth of a toothed wheel 62 rotatable with the print wheel associated therewith. Depression of a push button causes rotation of the corresponding print wheel due to the engagement of the ratchet tooth with one of the teeth of the toothed wheel. The ratchet mechanism is so arranged that, for each push operation of button 15, the wheel position is moved by one increment in an increasing direction of print value whereas for each push operation of button 16 the wheel position is moved by one increment in a decreasing direction of print value. A cover 17 is secured to the end of the print drum 14 to enclose the print wheel setting mechanisms and the push buttons 15, 16 project through the end face of the cover. Indicator wheels 18 are connected by gearing to the respective print wheels of the group and carry, on their peripheries, values corresponding to the type faces on the print wheels. These indicator wheels 18 are visible through a window 19 in the cover 17 to enable a user to see the value to which the print wheels have been set. The second group of print wheels is utilised for printing a date and these wheels are manually rotated into the desired position.

The printing drum may carry additional printing elements in order to enable the printing of a unique identifier relating to the use of this form of post stamping machine. An incrementing non-resettable printing counter may be provided in the print drum whereby a reference or item serial number may be printed on each postal item. Also as is common in franking machines the print drum may carry a second printing plate for printing of advertising or other invariable material. The identifier and item serial number may be printed between the postal impression and the advertisement.

Power for rotating the print drum 14 to effect printing on a postal item is provided by a mechanical device such as a tensator spring motor housed in the rear housing 12 of the base 10 and coupled to the shaft of the print drum. The tensator spring motor is primed by means of a lever extending through a vertical slot to the exterior of the rear housing 12 and terminating in a manually operable button 22 at the rear of the machine. A trip mechanism, actuated by insertion of a postal item along the feed bed into the nip of the print drum and a pressure roller 21, releases the tensator spring motor to rotate the print drum through a single revolution. If desired an interlock to prevent accidental actuation of the trip mechanism may be provided in the form of a mechanical push button operable alternately to lock and unlock the trip mechanism. The drive mechanism for providing power to rotate the print drum and to effect ejection of the mail item will be described in more detail hereinafter.

Inking of the printing plate and of the print wheels is effected by means of an inked roller 20 engaging the print elements as they are rotated, into contact with a postal item, by rotation of the print drum 14 by the tensator spring motor. The pressure roller 21, resiliently mounted, is located in the base 10 and projects through the feed bed 11 toward the print drum 14 to press the face of a postal item into contact with the print drum and feed the postal item with rotation of the print drum during printing of the stamp on the postal item.

It will be appreciated that the post stamping machine as described above does not include any means for accounting for the usage of postage or for registering credit available for stamping. Instead, a user of the machine would stamp postal items for despatch and make payment in respect of the total postal charge for a batch of stamped items either by means of payment at a postal authority counter or approved service point or by means of a prearranged debit account facility. It is envisaged that users with a debit account would enclose a batch of postal items in a specially marked envelope together with a statement slip and this specially marked envelope could then be posted in any mail box. The statement slip would contain details of identification and authorisation. If desired an authentication code may also be included. This would save time and avoid the necessity of obtaining and affixing stamps to postal items. Due to the omission of accounting means for registering credit available and postage values used there is no need for securely housing the stamping machine. Consequently the cost of manufacture is reduced to such an extent that purchase of such a stamping machine would be economic even for those whose use of the postal service is relatively small. Since payment, either direct or by pre-arranged debit account, takes place at the time of receipt of the stamped postal items by the postal authority the postal authority has no security risk. Any item improperly stamped or not properly accounted for in the payment can be rejected by the authority.

Figure 3:
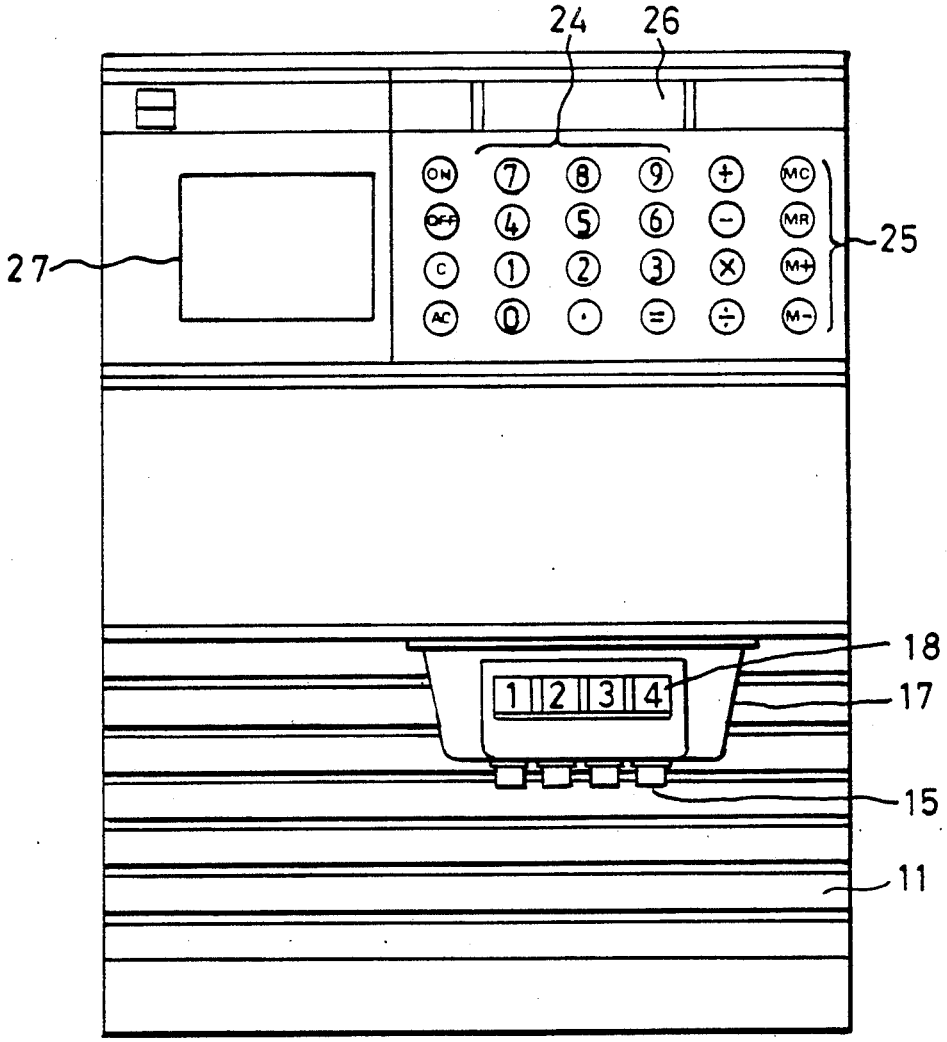
FIG. 3 is a plan view of the post stamping machine.

Because the machine as described has no provision for accounting, a user would have no means of recording usage of the machine. Usage information may be provided by the provision of a standard type of hand calculator mounted on the machine. A mounting for a calculator 23 is provided by a receptacle formed in the upper portion of the rear housing 12 and may be seen more clearly from FIG. 3. The calculator 23 has digital input buttons 24, control buttons 25 relating to usage of a memory within the calculator 23 and a digital display 26. In use of the stamping machine, the user sets the printing elements by the push buttons 15, 16 and in addition enters that value into the calculator by means of the digit buttons. A contact set 66 is provided on the stamp machine which is operated by rotation of the print drum through a print cycle. The contact set may be operated by a cam 67 on the drum. This contact set is connected to the M+ memory button of the calculator and, as a result for each rotation of the print drum through a printing cycle, the M+ input of the calculator is operated and the value of the current stamping is added to any value already stored in the memory. Hence the accumulated total value of usage of postage is registered in the memory of the calculator. Since many items within a batch of postal items will be stamped with the same value, resetting of the print wheels and entering the postal value in the calculator will be relatively infrequent and hence not unduly onerous. If the calculator is of the kind provided with a tally printer, a tally of postage operations could be obtained. Due to the mass production of hand calculators, the cost of such devices is very low and the provision of a form of accounting by means of such a calculator adds little to the cost of the overall machine. Instead of providing an electrical contact set for operation of the memory input to the calculator, which would mean providing an electrical connection to the interior of the calculator, the M+ button of the calculator may be operated mechanically by a mechanism responsive to rotation of the print drum. Such a mechanism may comprise a mechanical linkage operated by the cam 67 to depress the M+ button.

While postal items comprising envelopes will pass through the space between the print drum and the feed bed and hence can be printed upon directly by the printing mechanism, other items such as relatively thick packets or parcels would be too large to pass through that space. Accordingly the printing of the postage stamp may be made upon labels for subsequent affixing to the postal item. Provision for storing a supply of such labels may be made by means of a hopper 27 formed in the rear housing and opening upwardly alongside the calculator 23, an end of labels 28 contained in the hopper projecting from the hopper to allow easy withdrawal thereof.

The calculator is powered, as is usual with hand calculators, by means of a long life lithium battery contained within the calculator casing. Accordingly, since the stamp machine is mechanically powered, no mains power supply is required for operation of the postage stamping machine.

A cover 29 extends forwardly from the rear housing 12 around the print drum 14 leaving only the lower portion of the print drum exposed to permit printing on postal items fed along the feed bed 11. The cover 29 or a portion thereof may be hinged to permit access to the print drum for the purpose of setting the second group of print wheels which print the date and to permit replacement of the inking roller 20.

Figure 4A:
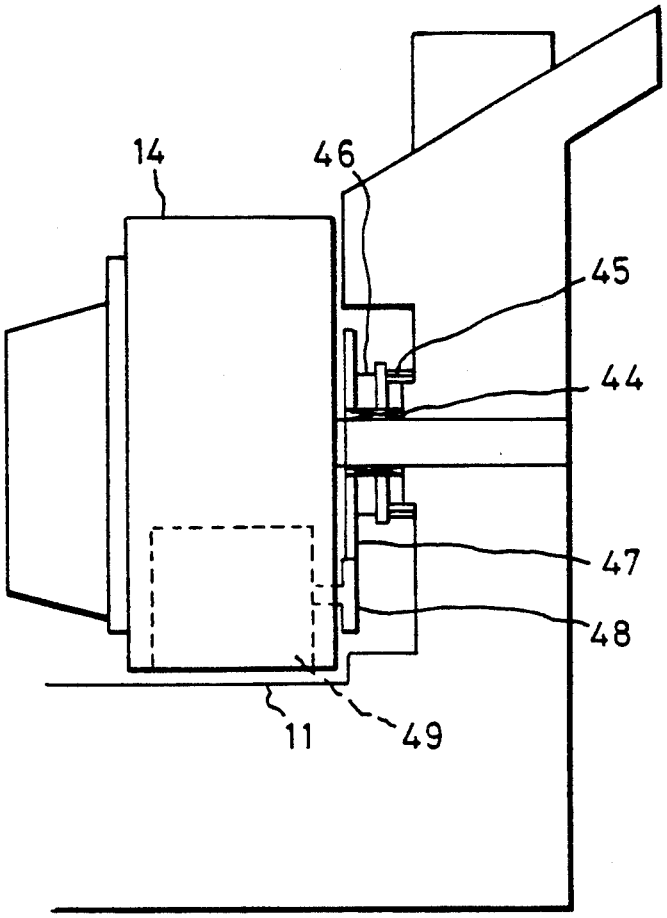
FIGS. 4*a* and 4*b* are side and rear views respectively of a drive mechanism for a print drum and mail item feed of the stamping machine.
Figure 4B:
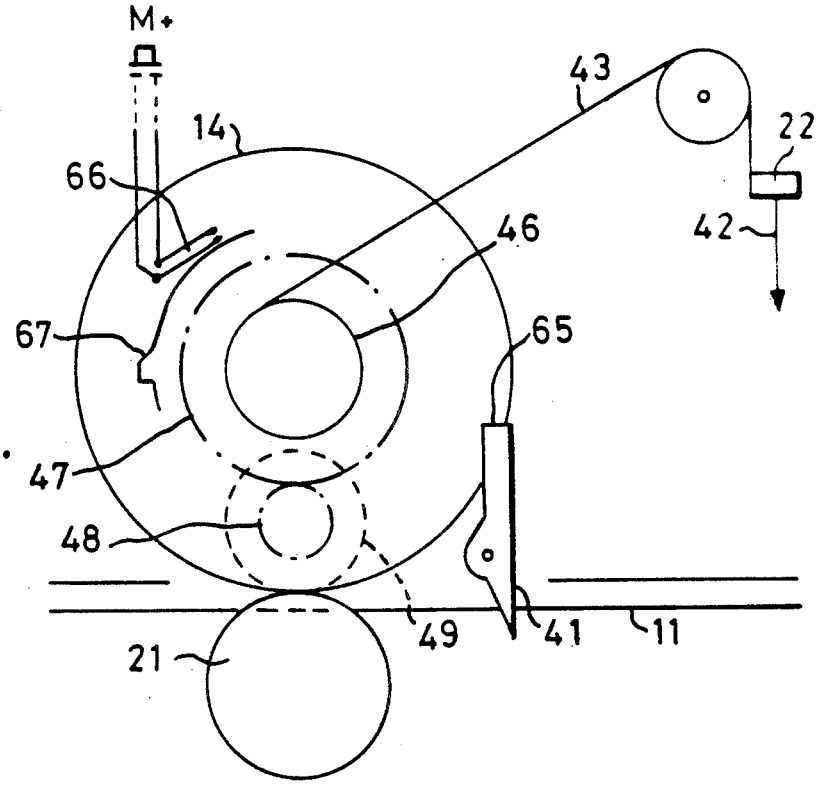

Referring now to FIGS. 4*a* and 4*b*, a print drum stop lever 41 is pivotally mounted to project into the path of feed of a mail item along the feed bed 11 and in the position shown, the lever engages an abutment 65 on the print drum to prevent rotation of the drum. Insertion of a mail item along the feed bed moves the stop lever out of engagement with the abutment and releases the print drum for rotation about its axis. Operating lever 22 is connected to the print drum 14 by means of a cord or cable 43 which wraps around a reel 46 connected to the print drum by means of a one way clutch 44. Depression of the lever 22, as indicated by arrow 42, causes unwinding of the cord from reel 46 and rotation of the print drum, in a clockwise direction as seen in FIG. 4*b*, to print the postage impression of the mail item and, in conjunction with the pressure roller 21, to carry the mail item part way through the machine along the feed bed. When the operating lever 22 is released, the one way clutch 44 allows a spring 45 to rewind the cord or cable onto the reel 46 with the print drum stationary, thus returning the operating lever to its initial position. An ejection roller 49 is housed within the print drum 14 and extends through an aperture in the drum periphery. When the print drum has returned to its initial position after completion of the single rotation of the print cycle, the ejection roller 49 is located in opposition to the pressure roller 22 and the mail item is gripped between the ejection roller and the pressure roller. Rotation of the reel 46 relative to the print drum during rewinding of the cord drives, through gearing 47 and 48, the ejection roller 49 to eject the mail item from the machine.

Figure 5A:
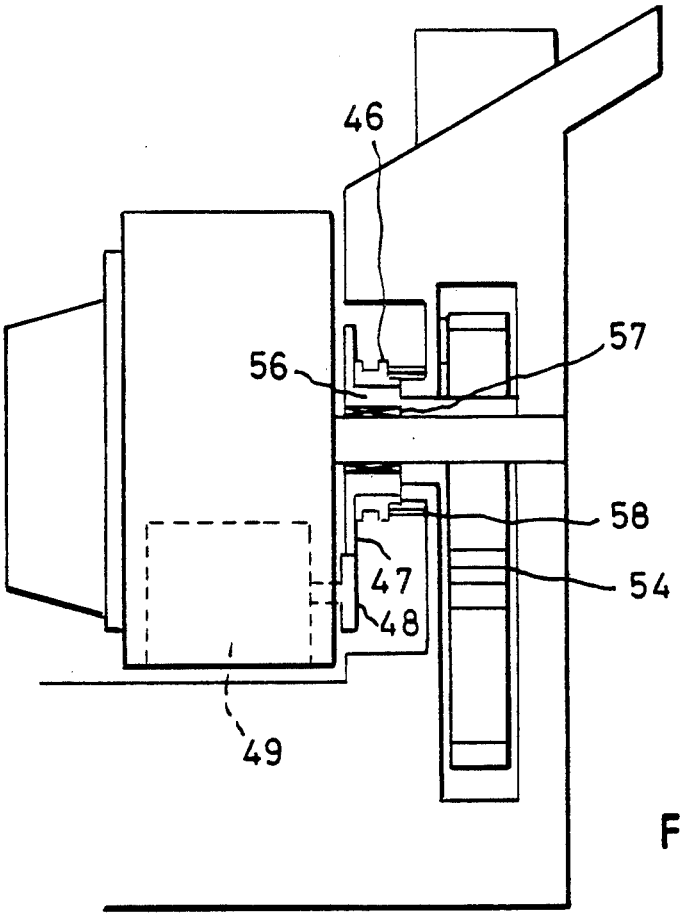
FIGS. 5*a* and 5*b* are side and rear views respectively of an alternative drive mechanism for the print drum and mail item feed of the stamping machine.
Figure 5B:
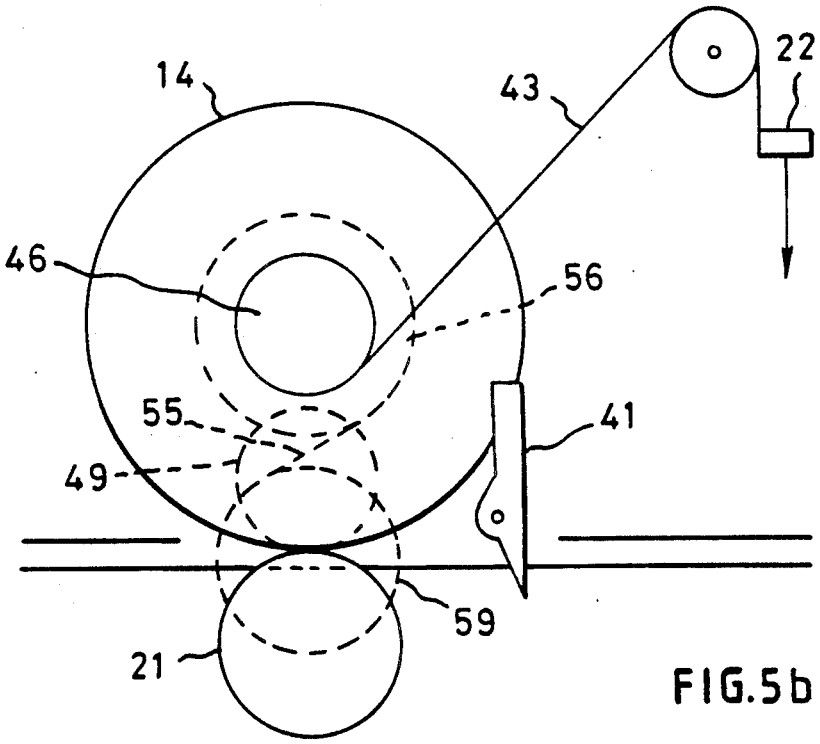

In an alternative drive mechanism, shown in FIGS. 5*a* and 5*b*, the print drum is rotated by means of a constant torque spring motor 54. Normally the print drum is prevented from rotating by the print drum stop lever 41. Insertion of a mail item operates the lever 44 and the print drum rotates under power from the motor 54 thereby printing a postage impression on the mail item and carrying the mail item part way through the machine. The operating lever 22 is connected by a cord 43 to a reel 46 on which the cord is wound. The reel 46 is connected by means of a ratchet or one way clutch to a spring drum 56 on which the spring 55 of the spring torque motor 54 is wound. The spring drum is connected to the print drum by means of a one way clutch 57. When the print drum is rotated by the motor 54, the spring 55 of the motor unwinds from the spring drum 56 and winds onto a take up drum 59. Rotation of the reel 46 by the cord causes the motor spring 55 to be rewound onto the spring drum 56 and, in the same manner as described in relation to FIGS. 4*a* and 4*b*, drives the ejection roller 49 through gears 47 and 48. The one way clutch 57 between the spring drum and the print drum prevents unwinding of the motor spring 55 until the print drum is released by insertion of a mail item. When the operating lever 22 is released, the cord is rewound onto the reel 46 by a spring 58.

A motor driven by a simple clock spring or torsion spring may be used instead of the constant torque motor.

We claim:

1. A postage stamping machine comprising a base unit; a print drum rotatable relative to the base unit and carrying settable print elements for printing a postal impression including a postage value on a postal item; manually operable means on the drum to set said print elements to print a desired value of postage; and a mechanical spring powered motor operable to rotate said print drum to effect stamping of a postal item with the desired value of postage; said mechanical spring powered motor comprising a tensator spring motor with means to manually prime the motor.

2. A postage stamping machine comprising a base unit; a print drum rotatable relative to the base unit and carrying settable print elements for printing a postal impression including a postage value on a postal item; manually operable means on the drum to set said print elements to print a desired value of postage, said manually operable means including manually operable buttons connected to said print elements by ratchet means, each operation of a button being effective to move the print element by one increment; and a mechanical spring powered motor operable to rotate said print drum to effect stamping of a postal item with the desired value of postage.

3. A machine as claimed in claim 2 wherein a first manually operable button is connected to the print element by the ratchet means in such manner that operation of the first button is effective to move the print element by one increment in an increasing value direction and a second manually operable button is connected to the print element by the ratchet means in such manner that operation of the button is effective to move the print element by one increment in a decreasing value direction.

4. A postage stamping machine as claimed in claim 3 wherein each print element comprises a print wheel carrying type faces on the periphery thereof and wherein the machine includes a toothed ratchet wheel drivingly connected to the print wheel; a first ratchet tooth operable by manual operation of an associated one of the first buttons to engage with a tooth of the ratchet wheel to rotate the ratchet wheel and thereby rotate the print wheel in the increasing value direction; a second ratchet tooth operable by manual operation of an associated one of the second buttons to engage with a tooth of the ratchet wheel to rotate the ratchet wheel and thereby rotate the print wheel in a decreasing value direction opposite to said increasing value direction.

5. A postage stamping machine as claimed in claim 2 including means on the print drum connected to the print elements and indicative of the postal stamp value to which the print elements have been set.

6. A postage stamping machine as claimed in claim 2 wherein each print element comprises a print wheel carrying type faces on the periphery thereof and wherein the machine includes a toothed ratchet wheel drivingly connected to the print wheel; a ratchet tooth operable by manual operation of an associated one of the push buttons to engage with a tooth of the ratchet wheel to rotate the ratchet wheel and the print wheel drivingly connected thereto.

7. A postage stamping machine comprising a base unit; a print drum rotatable relative to the base unit and carrying settable print elements for printing a postal impression including a postage value on a postal item; manually operable means on the drum to set said print elements to print a desired value of postage; a mechanical spring powered motor operable to rotate said print drum to effect stamping of a postal item with the desired value of postage; a calculator having digital input buttons for the manual input of values corresponding to postal values to which said print elements are manually set and having a memory; memory input means on the calculator operable to enter a value, manually input by means of said digital input buttons, into said memory; and means operated in response to rotation of said print drum through a printing cycle to operate said memory input means.

8. A postage stamping machine as claimed in claim 7 wherein the means operated in response to rotation of the print drum through a printing cycle comprises a cam connected to and rotatable by the print drum; a contact set operated by rotation of the cam; said contact set being electrically connected to the memory input means.

9. A postage stamping machine comprising a base unit; a print drum rotatable relative to the base unit and carrying settable print elements for printing a postal impression including a postage value on a postal item; manually operable means on the drum to set the print elements to print a desired value of postage; a pressure roller mounted to press postage items into engagement with the print drum; means to rotate the print drum in a printing cycle from an initial position through a printing position in which the print elements are brought into printing engagement with the postal item and thence to said initial position an ejection roller carried by and rotatable relative to said print drum and effective to co-operate with said pressure roller when said print drum is in said initial position to grip a postal item between said ejection roller and said pressure roller; and ejection means operable when the print drum is in said initial position to rotate the ejection roller relative to the print drum the ejection roller to feed to postal item thereby eject the postal item from the machine.

10. A postage stamping machine as claimed in claim 9 including a mechanical spring powered motor to rotate the print drum in the print cycle; manually operable means to prime the motor when the drum is in its initial position; and said manually operable means being coupled to the ejection means to drive the ejection roller during priming of the motor.

11. A postage stamping machine comprising a base unit; a print drum rotatable relative to the base unit and carrying a plurality of settable print elements for printing a postal impression including a postage value and an identification on a postal item; manually operable means on the drum to set a group of said print elements to print a desired value of postage; and a mechanical spring powered motor operable to rotate said print drum to effect stamping of a postal item with the desired value of postage and identification; said mechanical spring powered motor comprising a tensator spring motor with means to manually prime the motor.

12. A postage stamping machine comprising a base unit; a print drum rotatable relative to the base unit and carrying a plurality of settable print elements for printing a postal impression including a postage value and an identification on a postal item; manually operable means on the drum to set a group of said printing elements to print a desired value of postage, said manually operable means including manually operable buttons connected to said print elements of said group by ratchet means, each operation of a button being effective to move the print element by one increment; and a mechanical spring powered motor operable to rotate said print drum to effect stamping of a postal item with the desired value of postage and said identification.

13. A postage stamping machine comprising a base unit; a print drum rotatable relative to the base unit and carrying a plurality of settable print elements for printing a postal impression including a postage value and an identification on a postal item; manually operable means on the drum to set said group of said print elements to print a desired value of postage; a mechanical spring powered motor operable to rotate said print drum to effect stamping of a postal item with the desired value of postage and said identification; a calculator having digital input buttons for the manual input of values corresponding to postal values to which the print elements are manually set and having a memory; memory input means on the calculator operable to enter a value manually input by means of said digital input buttons, into said memory; and means operated in response to rotation of the print drum through a printing cycle to operate said memory input means.

* * * * *